US006019252A

United States Patent [19]

Benecke et al.

[11] Patent Number: 6,019,252

[45] Date of Patent: Feb. 1, 2000

[54] AEROSOL CAN FOR ACIDIC DETERGENT COMPOSITIONS

[75] Inventors: Arnold George Benecke, Indian Springs; Frank Leslie Carrier, Milford; Ricky Ah-Man Woo, Hamilton, all of Ohio

[73] Assignee: The Procter & Gamble Company, Cincinnati, Ohio

[21] Appl. No.: 09/051,562

[22] PCT Filed: Oct. 1, 1996

[86] PCT No.: PCT/US96/15690

§ 371 Date: Apr. 13, 1998

§ 102(e) Date: Apr. 13, 1998

[87] PCT Pub. No.: WO97/13707

PCT Pub. Date: Apr. 17, 1997

Related U.S. Application Data

[60] Provisional application No. 60/005,210, Oct. 11, 1995.

[51] Int. Cl.[7] ..... B65D 35/28

[52] U.S. Cl. ..... 222/95; 222/105; 222/386.5

[58] Field of Search ..... 222/95, 105, 386.5, 222/183

[56] References Cited

U.S. PATENT DOCUMENTS

| | | | |
|---|---|---|---|
| 3,097,766 | 7/1963 | Biehl et al. | 222/135 |
| 3,731,854 | 5/1973 | Casey | 222/386.5 |
| 4,387,833 | 6/1983 | Venus, Jr. | 222/95 |
| 4,964,540 | 10/1990 | Katz | 222/95 |
| 5,111,971 | 5/1992 | Winer | 222/386.5 |
| 5,232,126 | 8/1993 | Winer | 222/95 |
| 5,265,765 | 11/1993 | Maier | 222/105 |

*Primary Examiner*—Keats Quinalty
*Attorney, Agent, or Firm*—Jason J. Camp

[57] ABSTRACT

A plastic container (liner) that fits closely inside a conventional aerosol can to provide protection for the can. The completed liner/container and can assembly is filled with, e.g., an acidic detergent composition and aerosol propellant. Inwardly curved channels are provided linearly down the sides of the plastic container to allow air to escape when the plastic liner/container is inserted into the body of the aerosol can before the top is added to the can. The plastic container is molded into a collar around the valve opening in the top of the can after the top is attached to the body to form a "pre-assembly" container that is then filled. An acid compatible valve assembly is attached through the valve opening to seal the can, and propellant is added.

9 Claims, 2 Drawing Sheets

AEROSOL CAN FOR ACIDIC DETERGENT COMPOSITIONS

This application is a 371 of our International Application PCT/US96/15690, filed Oct. 1, 1996, which claims priority from our United States Provisional Application No. 60/005,210, filed Oct. 11, 1995.

BACKGROUND OF THE INVENTION

Field of the Invention

This invention relates to aerosol cans containing compositions which are not compatible with ordinary aerosol cans formed from normal steel plate. Typically such compositions require that very expensive structures be used to avoid any contact between the composition and the can. Typical compositions are those that are highly acidic. Although the cans can be coated, it is difficult to assure that the coating is completely without holes. Solutions to the problem have included using liners that are used to contain only the composition, with the propellant being outside the liner. However, detergent compositions, especially acidic compositions that are useful in cleaning bathroom soils. benefit from having the propellant in the composition. The aerosol propellant expands to provide improved distribution and/or foam for improved visibility of the treated portions of the surface. Such consumer products also require that the individual articles be made quickly and inexpensively.

SUMMARY OF THE INVENTION

The invention relates to the use of a plastic container (liner) that fits closely inside a conventional aerosol can to provide protection for the can. The completed liner/container and can assembly is filled with, e.g., an acidic detergent composition and aerosol propellant. In order to manufacture the assembled container/can. inwardly curved channels are provided linearly down the sides of the plastic container to allow air to escape when the plastic liner/container is inserted into the body of the aerosol can before the top is added to the can. The plastic container is molded into a collar around the valve opening in the top of the can after the top is attached to the body. This "pre-assembly" container is then filled with the active composition to the desired amount. An acid compatible valve assembly is attached through the valve opening to seal the can, and propellant is added in a typical through-the-valve operation.

DESCRIPTION OF THE PREFERRED EMBODIMENTS

Figure 2:
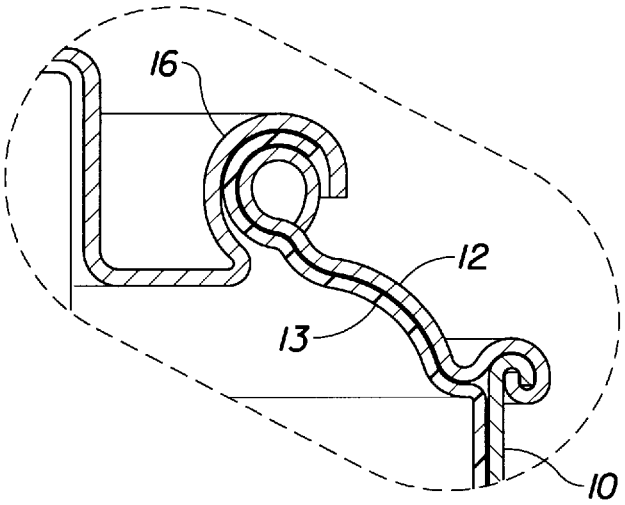
FIG. 2 is a close up sectional view of the seals between the base and top of the can and the valve assembly and top of the pre-assembly.
Figure 1:
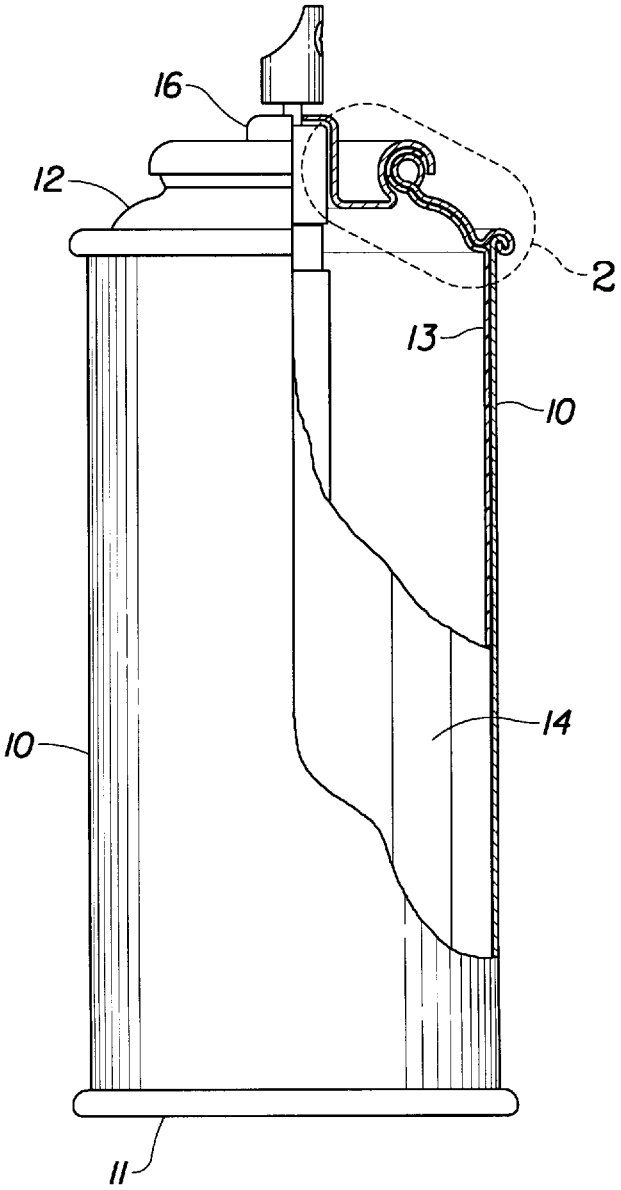
FIG. 1 is an elevational view of the complete assembly, partially sectional, with the valve being not in section since it is any conventional valve that is resistant to acid attack. The plastic container is shown before pressurization, to display the air flow channels as they appear before the aerosol propellant is added.
Figure 5:
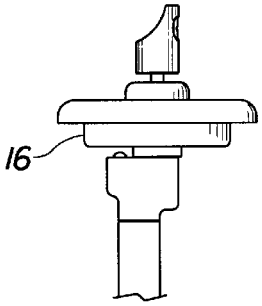
FIG. 5 is a view of a typical valve assembly.
Figure 6:
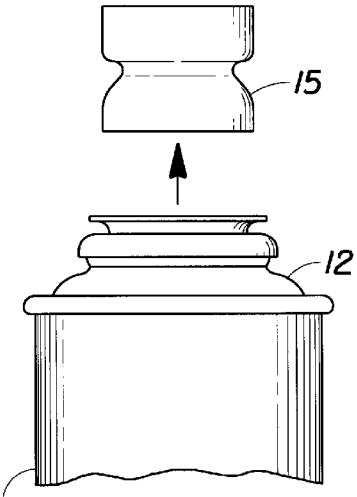
FIG. 6 is an exploded view of the top of the pre-assembly after the liner/container is trimmed.

The aerosol can is a conventional can, preferably metal, either aluminum or tin plate steel, more preferably tin plate.

The base of the can comprises a cylinder wall 10, a bottom 11, and a top 12 that are either integral with the cylinder 10 (bottom only), or attached thereto by crimping, welding, gluing, and/or clamping. The essence of the invention is to provide a plastic liner/container 13 that is independently able to contain the composition, e.g., acidic detergent composition, that will ordinarily attack the can.

The liner/container 13 is relatively heavy, having a thickness of from about 0.006 in. to about 0.035 in., preferably from about 0.015 in. to about 0.020 in. The liner/container is made of plastic, preferably polyolefin, more preferably polyethylene (preferably high density) or polypropylene, more preferably oriented high density polyethylene. The liner, or container, is relatively stiff, providing resistance to bending collapse, etc., when subjected to the force required to insert the liner into the can body. The air channels 14 in the liner/container provide both improved structural resistance to premature collapse of the liner/container and an egress for the air that would otherwise be trapped in the base when the liner/container is inserted, since the liner/container 13 is dimensioned to almost touch the base.

Preferably the transitions between the channels 14 and the cylinder wall 10 are smooth and the channel 14 arc length is almost exactly the length of the arc of the circumference of the cylinder wall 10 that is adjacent the channel wall 14 after the pressure from the propellant reverses the curvature of the channel to conform to the curvature of the adjacent portion of the cylinder wall 10. Similarly, the transitions between the channel 14 and the bottom of the liner/container 13 should be smooth. Smooth transitions minimize the degree of sharp bending that occurs and thus minimizes the chance of cracking/leaking.

The liner/container 13 is preferably flexible to allow the liner/container 13 to mold to the interior surface of the aerosol can (10/11/12) when under pressure. This is especially important for the channels 14. They need to reverse the curvature from inward to outward without cracking. On the other hand, the plastic needs to be sufficiently rigid to prevent collapse of the liner/container 13 during the handling of the liner/container, including the insertion into the can base (10/11).

The liner/container 13 comprises a neck 15 which initially is a cylinder around which the can top 12 can be lowered to permit attachment to the cylinder wall 10 by crimping, welding, gluing, and/or clamping. The neck 15 is then trimmed and/or rolled down to the indicated collar configuration that acts as a seal between the can top 12 and the valve assembly 16. The valve assembly 16 is any valve that is resistant to attack by the active composition 17, which is inside the liner/container 13.

Acidic compositions useful herein comprise those disclosed in U.S. Pat. Nos. 4,247,408, Imamura et al.: 4,501,680, Aszman et al.; 4,699,728, Riehm et al.; 4,965,009, Baur et al.; 5,008,030, Cook et al.; 5,039,441, Thomas et al.; 5,061,393, Linares and Cilley; 5,192,460, Thomas et al.; and 5,384,063, Woo, Carrie, Cilley, Masters, Michael, and Vos, all of said patents being incorporated herein by reference. The compositions should not have ingredients, especially acidic ingredients, that will pass through the liner/container 13. As is known in the art, selection of the plastic and/or ingredients, will solve such a problem.

Hydrocarbon propellants will diffuse through polyolefin materials with time. This will occur with A31 (isobutane) using high density polyethylene as the material for the liner/container 13. This can be compensated for by ensuring the can seams are air tight so that an equilibrium is developed in the space between the liner/container 13 and the can (10+11+12). Extra propellant (e.g., A31) can be added to ensure complete evacuation of the product from the liner/container 13. For example, one would use 6% propellant by weight when 5% would normally be enough in an unlined can.

EXAMPLE

Figure 3:
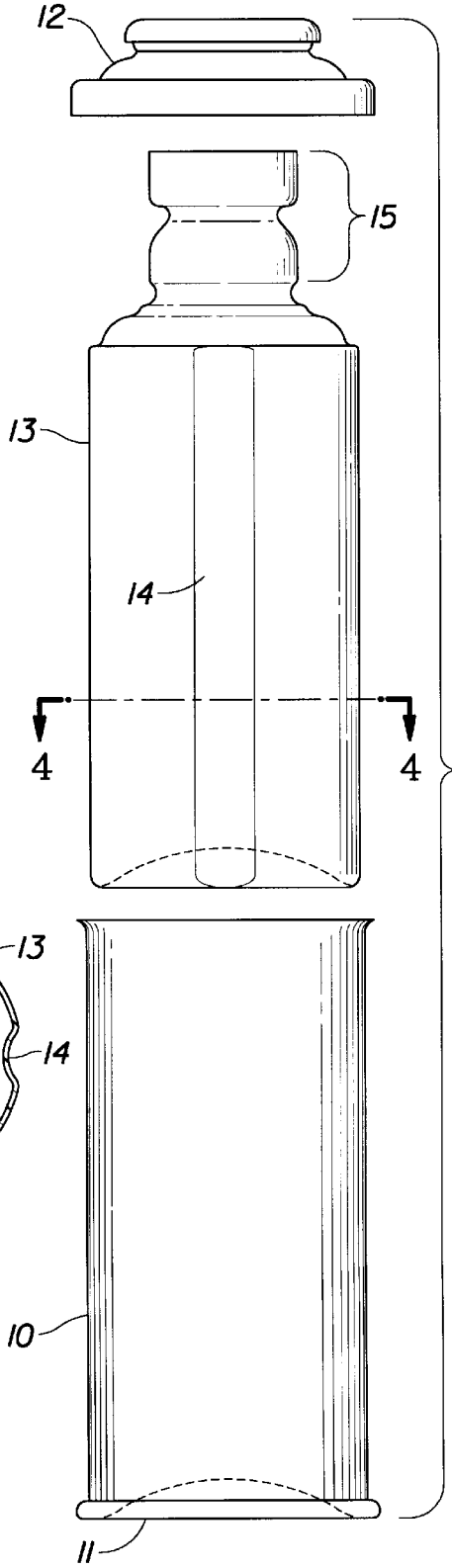
FIG. 3 is an exploded view of the "pre-assembly" with the liner/container before assembly.
Figure 4:
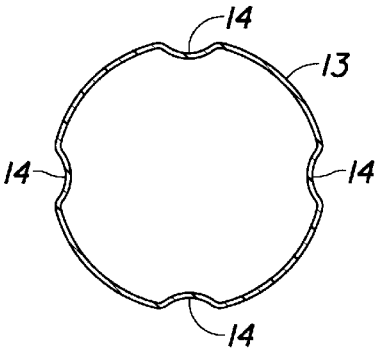
FIG. 4 is a cross section of the liner/container along the section line AA.

An oriented polyethylene liner/container having a thickness of about 0.014 in. and the configuration shown in FIG. 3, the neck having a small enough diameter for the top of a conventional aerosol can to fit around, is inserted into a base (bottom and cylindrical side wall) of a conventional aerosol can. The top of the aerosol can is lowered around the cylinder neck and attached to the base of the aerosol can. The neck of the liner/container is then rolled outward and downward to form the collar as shown in the Figure. The composition of Example VII B of U.S. Pat. No. 5,384,063, about 432.5 gms., is added to the liner/container and a aerosol dispensing valve (Seaquist SA-76-2®) is crimped to the aerosol can to seal the can. About 6%, about 27.6 gm., of aerosol propellant (isobutane, aerosol grade A31. vapor pressure at 70° F. of 31 psig) is inserted through the nozzle to complete the product.

The complete product is capable of being stored and used for its intended purpose.

What is claimed is:

1. A plastic liner for an aerosol can having one, or more, inwardly curved channels along the length of the liner, the remainder of the liner being only slightly smaller than the inside of said aerosol can when unfilled, the surface of each of said channels being approximately the same as the portion of the inside of said aerosol can that is opposite said channel when the unfilled liner is inside said aerosol can and said liner being sufficiently flexible to permit the reversal of the curvature of said curved channels from inward to outward when the inside of said plastic liner is exposed to pressure.

2. The liner of claim 1 which is fabricated from polyolefin.

3. The liner of claim 2 which is fabricated from polyethylene or polypropylene.

4. The liner of claim 3 wherein said polyethylene is high density polyethylene.

5. The liner of claim 3 wherein said polyethylene is oriented polyethylene.

6. A pre-assembly for an aerosol can comprising an aerosol can bottom, the liner of claim 1, and an aerosol can top crimped to said aerosol can bottom, wherein a portion of said liner is formed into a collar around the outer opening of said aerosol can top.

7. A completed aerosol can comprising the pre-assembly of claim 6 and a valve assembly attached thereto, that is resistant to acid, said can containing an acidic detergent composition.

8. The process of preparing the completed aerosol can of claim 7 comprising the steps of:

a. inserting the liner of claim 1, said liner comprising a neck portion, into the bottom portion of an aerosol can;

b. crimping a can top, placed around said neck portion, onto said bottom portion; and c. forming a collar and seal from said liner's neck portion to form a pre-assembly.

9. The process of claim 8 comprising the additional steps of:

a. filling said pre-assembly with an acidic detergent composition;

b. inserting and sealing an acid resistant aerosol dispensing valve assembly in said pre-assembly; and c. adding aerosol propellant through said valve assembly.

* * * * *